US011343605B1

(12) United States Patent
Dusan

(10) Patent No.: US 11,343,605 B1
(45) Date of Patent: May 24, 2022

(54) SYSTEM AND METHOD FOR AUTOMATIC RIGHT-LEFT EAR DETECTION FOR HEADPHONES

(71) Applicant: Apple Inc., Cupertino, CA (US)

(72) Inventor: Sorin V. Dusan, San Jose, CA (US)

(73) Assignee: APPLE INC., Cupertino, CA (US)

( * ) Notice: Subject to any disclaimer, the term of this patent is extended or adjusted under 35 U.S.C. 154(b) by 37 days.

(21) Appl. No.: 16/729,169

(22) Filed: Dec. 27, 2019

Related U.S. Application Data

(63) Continuation of application No. 15/588,258, filed on May 5, 2017, now abandoned.

(51) Int. Cl.
*H04R 1/10* (2006.01)
*H04R 1/40* (2006.01)
(Continued)

(52) U.S. Cl.
CPC ..... *H04R 1/1041* (2013.01); *G10K 11/178* (2013.01); *G10K 11/17879* (2018.01); *G10K 11/17885* (2018.01); *H04R 1/406* (2013.01); *G10K 2210/1081* (2013.01); *G10K 2210/3046* (2013.01); *H04R 1/1008* (2013.01);
(Continued)

(58) Field of Classification Search
CPC ..... H04R 2410/07; H04R 2420/07; H04R 1/1008; H04R 1/1083; H04R 3/005; H04R 3/12; H04R 5/04; H04R 1/1041; H04R 1/406; H04R 25/505; H04R 1/10; G10K 11/17879; G10K 11/17785; G10K 11/178; G10K 2210/1081; G10K 2210/3046; G10L 25/78; G10L 25/90; G10L 21/0388; G10L 21/034; G10L 2025/783; G10L 2021/02166
See application file for complete search history.

(56) References Cited

U.S. PATENT DOCUMENTS 8,605,913 B2 * 12/2013 Schwerdtner ..... H04R 25/552 381/23.1
9,516,442 B1 * 12/2016 Dusan ..... H04R 1/222
(Continued)

FOREIGN PATENT DOCUMENTS

WO WO-2019109420 A1 * 6/2019 ..... H04R 1/1091

*Primary Examiner* — Matthew A Eason
*Assistant Examiner* — Kuassi A Ganmavo
(74) *Attorney, Agent, or Firm* — Womble Bond Dickinson (US) LLP

(57) ABSTRACT

System for automatic right-left ear detection for headphone comprising: first earcup and second earcup that are identical. Each of first and second earcups includes: first microphone located on perimeter of each earcup, when first earcup is worn on user's right ear first microphone of first earcup is at location farthest from user's mouth when headphone is worn in normal wear position; second microphone located on perimeter of each earcup, when first earcup is worn on user's right ear, second microphone of first earcup is at location closer than first microphone of first earcup to user's mouth; third microphone located inside each earcup facing user's ear cavity, fourth microphone located at perimeter and bottom center portion of each earcup and facing exterior of each earcup, and fifth microphone located on perimeter of each earcup above and to left of second microphone when looking at outside housing of each earcup.

27 Claims, 7 Drawing Sheets

(51) Int. Cl.

| | |
|---|---|
| ***G10K 11/178*** | (2006.01) |
| ***H04R 5/04*** | (2006.01) |
| ***H04R 3/00*** | (2006.01) |
| ***H04R 3/12*** | (2006.01) |

(52) U.S. Cl.
CPC ..... *H04R 1/1083* (2013.01); *H04R 3/005* (2013.01); *H04R 3/12* (2013.01); *H04R 5/04* (2013.01); *H04R 2201/109* (2013.01); *H04R 2410/07* (2013.01); *H04R 2420/07* (2013.01)

(56) References Cited

U.S. PATENT DOCUMENTS

| | | | | |
|---|---|---|---|---|
| 2004/0042629 | A1* | 3/2004 | Mellone | H04R 1/1058 381/310 |
| 2013/0279724 | A1* | 10/2013 | Stafford | H04R 5/04 381/309 |
| 2015/0245129 | A1* | 8/2015 | Dusan | H04R 3/005 381/71.6 |
| 2016/0360314 | A1* | 12/2016 | Iyengar | H04R 1/406 |
| 2017/0195769 | A1* | 7/2017 | Chang | H04R 1/1041 |
| 2018/0196776 | A1* | 7/2018 | Hershko | G06F 13/4291 |
| 2018/0268837 | A1* | 9/2018 | Ganeshkumar | G10L 21/0216 |

* cited by examiner

SYSTEM AND METHOD FOR AUTOMATIC RIGHT-LEFT EAR DETECTION FOR HEADPHONES

FIELD

Embodiments of the invention relate generally to a system and method for automatic right-left ear detection for headphones. Specifically, in one embodiment, the headphone includes two earcups that are identical and include at least three microphones to capture acoustic signals. In another embodiment, each of the earcups may be coupled to an earcup detector that receives the microphone signals from at least one of the earcups and determines which of the earcups is worn on the user's right ear.

BACKGROUND

Currently, headphones include a pair of earcups (or earbuds) that are marked as left and right, respectively. The right and left earcups are manufactured to include components specific to the right and left earcups, respectively, in order to allow the earcups to play audio corresponding to the right and the left stereo channels, respectively. Accordingly, the signals that are sent and received from each earcup are specific to the earcup being the right or the left earcup.

Further, a number of consumer electronic devices are adapted to receive speech via microphone ports or headphones. While the typical example is a portable telecommunications device (mobile telephone), with the advent of Voice over IP (VoIP), desktop computers, laptop computers and tablet computers may also be used to perform voice communications.

When using these electronic devices, the user also has the option of using the speakerphone mode or the headphone to receive his speech. However, a common complaint with these hands-free modes of operation is that the speech captured by the microphone port or the headset includes environmental noise such as wind noise, secondary speakers in the background or other background noises. This environmental noise often renders the user's speech unintelligible and thus, degrades the quality of the voice communication.

SUMMARY

Generally, embodiments of the invention relate to a system and method for automatic right-left ear detection for a headphone. It would be economically advantageous to manufacture a single earcup design that may be used as both the left and the right earcup. In addition, the headphones may only need to transmit to the connected device the user's speech from one of the earcups.

In one embodiment, a system for automatic right-left ear detection for a headphone comprises a first earcup and a second earcup that are identical. Each of the first and second earcups includes five microphones which are also used for purposes other than ear detection: a first microphone, a second microphone, a third microphone that is located inside each earcup facing the user's ear cavity, a fourth microphone located on a perimeter of each earcup in a triangle shape with the first and second microphones (top left, top right, and bottom middle), and a fifth microphone located above and to the left of the second microphone on a perimeter of each earcup when looking at an outside housing of each earcup. In one embodiment, when the first earcup is worn on a user's right ear the first microphone is at a location farther from a user's mouth and the second microphone is at a location closer to the user's mouth.

In another embodiment, each of the earcups may be coupled to an earcup detector that receives the microphone signals from at least one of the earcups. The earcup detector performs comparisons of the strength or ratio of strengths of the microphone signals from the at least three microphones with a plurality of thresholds to determine which of the earcups is being worn on the user's right ear. The earcup detector generates a right-left signal which is 1 when the earcup is being worn on the user's right ear and 0 when the earcup is being worn on the user's left ear. In one embodiment, that signal may be sent to a microphone controller to select the microphone signals received from the earcup that is being worn on the user's right ear for beamforming and/or transmitting to the connected device. In addition, the earcup detector also generates a VAD signal that may be used as input in noise suppression or automatic gain control.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Figure 1:
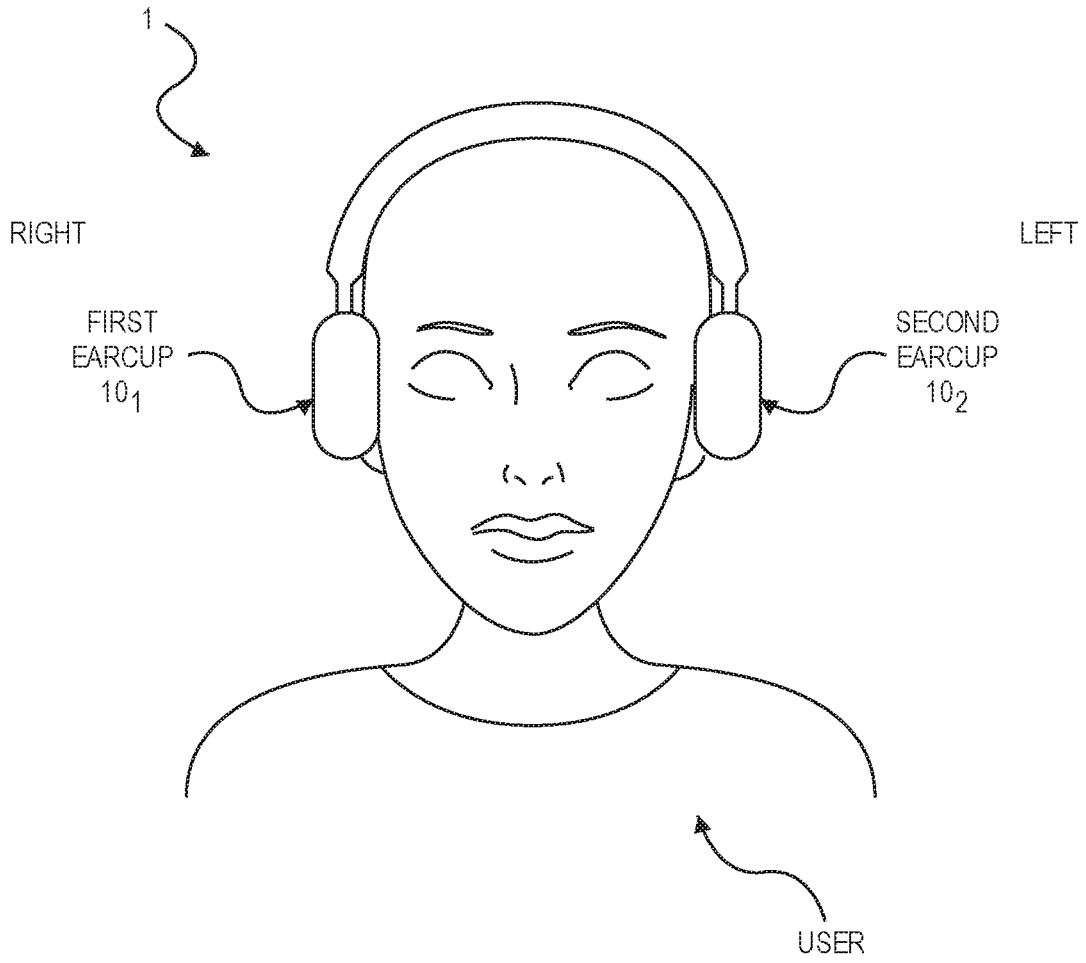
FIG. 1 illustrates an example of headphones in use according to one embodiment of the invention.

FIG. 1 illustrates an example of headphones in use according to one embodiment of the invention. The headphone in FIG. 1 is double-earpiece headset. The headphone includes a first earcup $\mathbf{10}_1$ and a second earcup $\mathbf{10}_2$ that are to be placed over the user's ears. While the headphone including earcups is discussed herein, it is understood that headphone that includes a pair of earbuds that are placed in the user's ear may also be used. Additionally, embodiments of the invention may also use other types of headsets.

Figure 2:
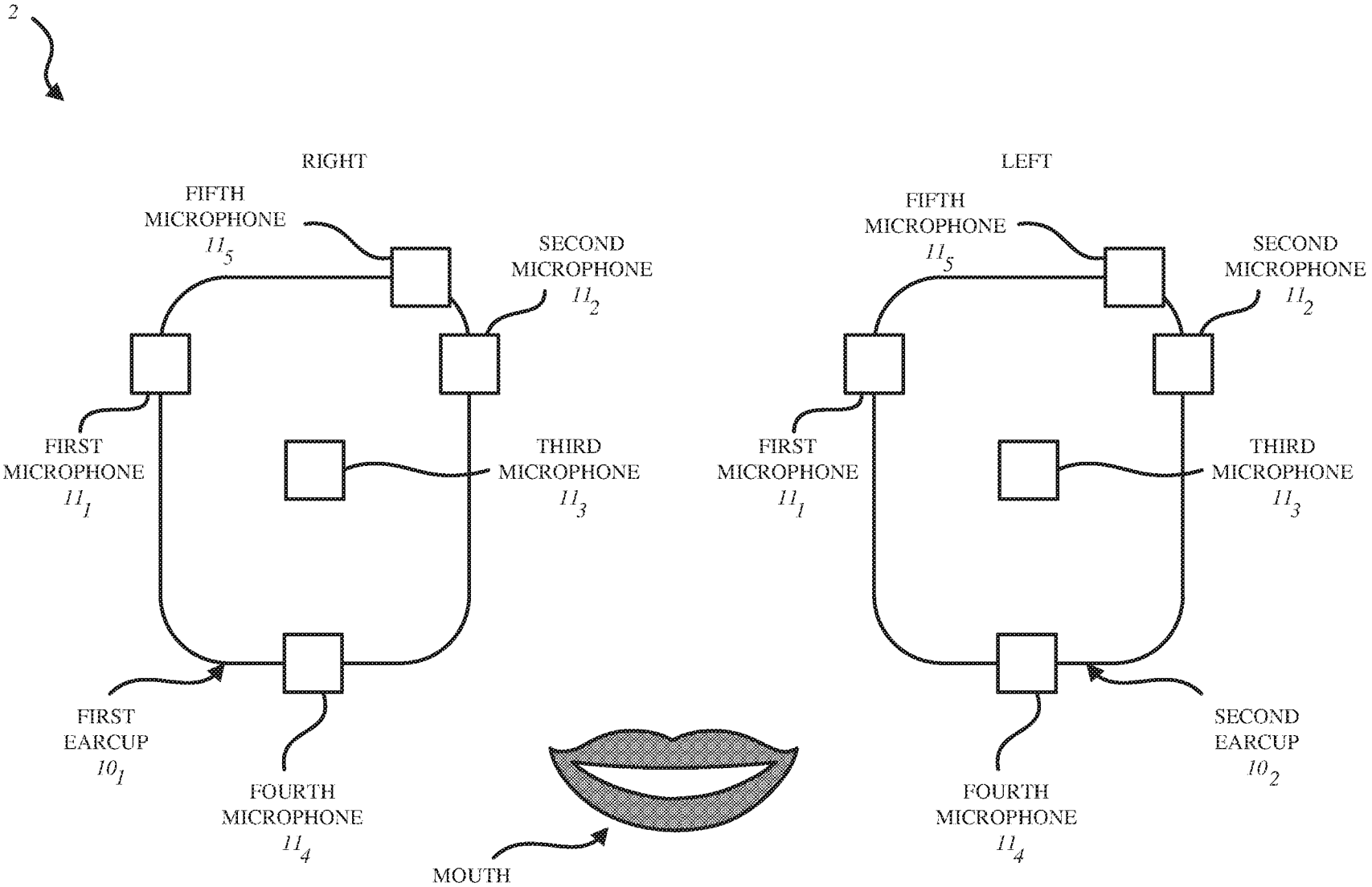
FIG. 2 illustrates an example of the details of the earcups in a first placement in accordance with one embodiment of the invention.
Figure 3:
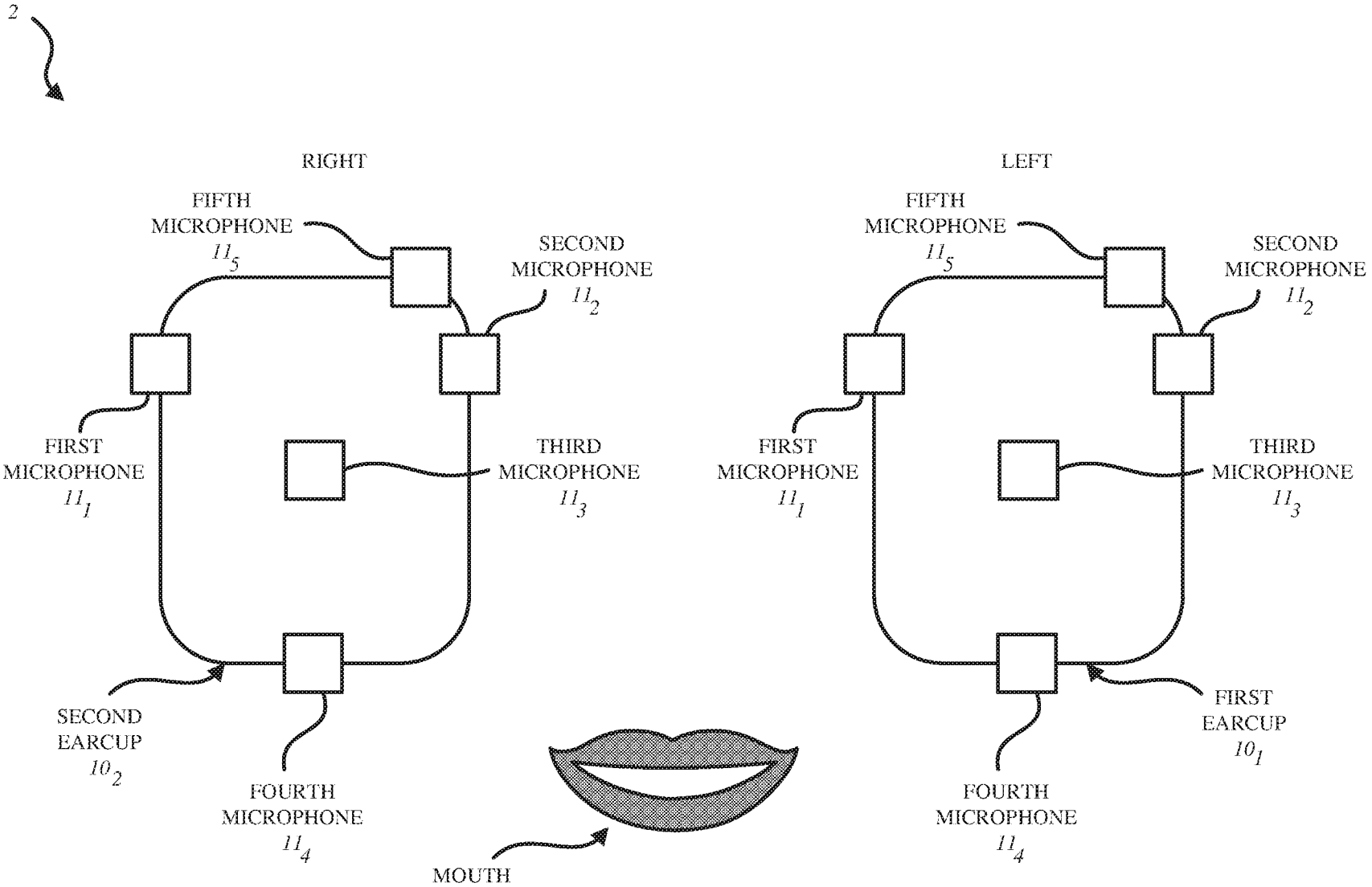
FIG. 3 illustrates an example of the details of the earcups in a second placement in accordance with one embodiment of the invention.

The user may place the earcups $\mathbf{10}_1$ and $\mathbf{10}_2$ on her ears in a first placement where the first earcup $\mathbf{10}_1$ is placed on her right ear and the second earcup $\mathbf{10}_2$ is placed on her left ear (FIG. 2) or in a second placement where the first earcup $\mathbf{10}_1$ is placed on her left ear and the second earcup $\mathbf{10}_2$ is placed on her right ear (FIG. 3).

The headphone on FIG. 1 may be coupled to a consumer electronic device 100 (or mobile device 100) (not shown) via a wire or wirelessly. In some embodiments, the earcups $\mathbf{10}_1$, $\mathbf{10}_2$ may be wireless and communicate with each other and with the electronic device 100 via BlueTooth™ signals. Thus, the earcups $\mathbf{10}_1$, $\mathbf{10}_2$ may not be connected with wires to the electronic device 100 (not shown) or between them, but communicate with each other to deliver the uplink (or recording) function and the downlink (or playback) function.

FIG. 2 illustrates an example of the details of the earcups in a first placement in accordance with one embodiment of the invention and FIG. 3 illustrates an example of the details of the earcups in a second placement in accordance with one embodiment of the invention.

As shown in FIGS. 2 and 3, the earcups $\mathbf{10}_1$, $\mathbf{10}_2$ are identical. It is understood that the earcups $\mathbf{10}_1$, $\mathbf{10}_2$ are identical within manufacturing tolerances. Each of the earcups includes a plurality of microphones $\mathbf{11}_1$-$\mathbf{11}_m$ (m>3) that may receive the user's speech. The microphones $\mathbf{11}_1$-$\mathbf{11}_m$(m>3) may be air interface sound pickup devices that convert sound into an electrical signal. As the user is using the headset to transmit her speech, environmental noise may also be present.

Figure 4:
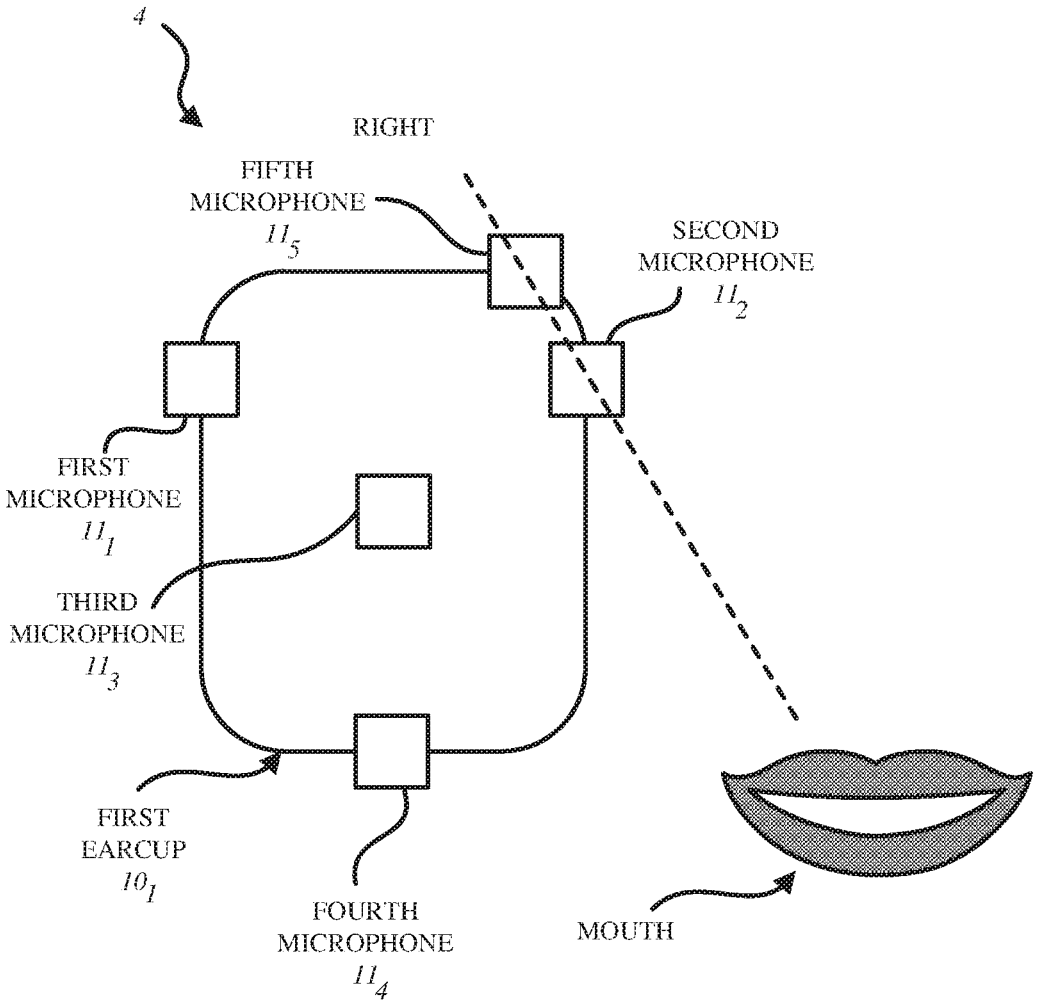
FIG. 4 illustrates an example of the details of the earcup being worn on the user's right ear in accordance with one embodiment of the invention.

In the FIGS. 2 and 3, each of the earcups $\mathbf{10}_1$, $\mathbf{10}_2$ includes five microphones that are respectively located in the same positions in each earcup $\mathbf{10}_1$, $\mathbf{10}_2$. However, it is understood that each of the earcups may include at least three microphones. For example, in one embodiment, each earcup $\mathbf{10}_1$, $\mathbf{10}_2$ includes three microphones being the first microphone $\mathbf{11}_1$, the second microphone $\mathbf{11}_2$ and the third microphone $\mathbf{11}_3$. In this embodiment, each earcup $\mathbf{10}_1$, $\mathbf{10}_2$ includes the first microphone $\mathbf{11}_1$ that is located on a perimeter of each earcup $\mathbf{10}_1$, $\mathbf{10}_2$. As shown in FIG. 2, when the first earcup $\mathbf{10}_1$ is worn on the user's right ear, the first microphone $\mathbf{11}_1$ is at a location farthest from the user's mouth when the headphone is worn in normal wear position. In one embodiment, the headphone is worn in normal wear position when the both earcups are placed on the user's ears and the headband portion of the headphone is at the top most portion of the user's head (e.g., the headphone is not worn off-angle) . The second microphone $\mathbf{11}_2$ is also located on the perimeter of each earcup $\mathbf{10}_1$, $\mathbf{10}_2$. As shown in FIG. 2, when the first earcup $\mathbf{10}_1$ is worn on the user's right ear, the second microphone $\mathbf{11}_2$ is at a location closer to the user's mouth than the first microphone $\mathbf{11}_1$. In one embodiment, the locations of the fifth microphone $\mathbf{11}_5$ and second microphone $\mathbf{11}_2$ are in a straight line with the user's mouth when the first earcup $\mathbf{10}_1$ is worn on the user's right ear (FIG. 4). In one embodiment, the first microphone $\mathbf{11}_1$ is located as far as possible from user's mouth and the second microphone $\mathbf{11}_2$ is located as close as possible to user's mouth. Referring to FIG. 2, the fourth microphone $\mathbf{11}_4$ is located at the perimeter and bottom center portion of each earcup $\mathbf{10}_1$, $\mathbf{10}_2$ and facing an exterior of each earcup $\mathbf{10}_1$, $\mathbf{10}_2$. In some embodiments, the first microphone $\mathbf{11}_1$, second microphone $\mathbf{11}_2$, and fourth microphone $\mathbf{11}_4$ may also be used for transparency features.

In another embodiment, each earcup $\mathbf{10}_1$, $\mathbf{10}_2$ includes three microphones being the first microphone $\mathbf{11}_1$, the second microphone $\mathbf{11}_2$ and the third microphone $\mathbf{11}_3$ which is located inside each earcup facing the user's ear cavity. In some embodiments, the first three microphones $\mathbf{11}_1$, $\mathbf{11}_2$, $\mathbf{11}_3$ and the fourth microphone $\mathbf{11}_4$ can be used to perform active noise cancellation (ANC).

In one embodiment, each earcup $\mathbf{10}_1$, $\mathbf{10}_2$ includes four microphones being the first microphone $\mathbf{11}_1$, the second microphone $\mathbf{11}_2$, the third microphone $\mathbf{11}_3$ and the fourth microphone $\mathbf{11}_4$. In each of these embodiments, at least three of the microphones $\mathbf{11}_1$-$\mathbf{11}_4$ capture acoustic signals and generate microphone signals that are processed to determine which earcup $\mathbf{10}_1$, $\mathbf{10}_2$ is currently being worn on the user's right ear.

In some embodiments, each earcup $\mathbf{10}_1$, $\mathbf{10}_2$ may also includes a fifth microphone $\mathbf{11}_5$ that is located on a perimeter of each earcup $\mathbf{10}_1$, $\mathbf{10}_2$ and above and to the left of the second microphone $\mathbf{11}_2$ when looking at an outside housing of each earcup. When the cup is on the right ear, the fifth microphone $\mathbf{11}_5$ may be used together with the second microphone to generate beamforming towards the user's mouth. As shown in FIG. 2, the fifth microphone $\mathbf{11}_5$ and the second microphone $\mathbf{11}_2$ of the first earcup $\mathbf{10}_1$ are located on the half of the first earcup $\mathbf{10}_1$ that is closer to the user's mouth when the first earcup $\mathbf{10}_1$ is worn on the user's right ear. In contrast, because the earcups $\mathbf{10}_1$, $\mathbf{10}_2$ are identical, in FIG. 2, the fifth microphone $\mathbf{11}_5$ and the second microphone $\mathbf{11}_2$ of the second earcup $\mathbf{10}_2$ are located on the half of the second earcup $\mathbf{10}_2$ that is farther from the user's mouth when the first earcup $\mathbf{10}_1$ is worn on the user's right ear.

Referring to FIG. 3, the second earcup $\mathbf{10}_2$ is being worn on the user's right ear. In FIG. 3, the fifth microphone $\mathbf{11}_5$ and the second microphone $\mathbf{11}_2$ of the second earcup $\mathbf{10}_1$ are located on the half of the second earcup $\mathbf{10}_2$ that is closer to the user's mouth when the second earcup $\mathbf{10}_2$ is worn on the user's right ear. In contrast, because the earcups $\mathbf{10}_1$, $\mathbf{10}_2$ are identical, in FIG. 3, the fifth microphone $\mathbf{11}_5$ and the second microphone $\mathbf{11}_2$ of the first earcup $\mathbf{10}_1$ are located on the half of the first earcup $\mathbf{10}_1$ that is farther from the user's mouth when the second earcup $\mathbf{10}_2$ is worn on the user's right ear.

When a processor (not shown) that may be included in the headphone or in the mobile device 100 that is separate from the headphone determines that the first earcup $\mathbf{10}_1$ is worn on the user's right ear, the fifth microphone $\mathbf{11}_5$ and the second microphone $\mathbf{11}_2$ of the first earcup $\mathbf{10}_1$ are known to be located on the half of the first earcup $\mathbf{10}_1$ that is closer to the user's mouth as shown in FIG. 4 and thus, the fifth microphone $\mathbf{11}_5$ and the second microphone $\mathbf{11}_2$ of the first earcup $\mathbf{10}_1$ may be used to perform voice beamforming towards the user's mouth to capture the user's speech and perform noise beamforming away from the user's mouth to capture environmental noise.

For example, the fifth microphone $\mathbf{11}_5$ and the second microphone $\mathbf{11}_2$ may be used to create a microphone array (i.e., beamformers) which can be aligned in the direction of user's mouth. Accordingly, the beamforming process, also referred to as spatial filtering, may be a signal processing technique using the microphone array for directional sound reception.

While not shown in the FIGS. 2-4, the earcups $\mathbf{10}_1$, $\mathbf{10}_2$ may also respectively include speakers to generate the audio signals corresponding to the left and right stereo channels based on the detection of which earcup $\mathbf{10}_1$, $\mathbf{10}_2$ is being worn on the user's right ear. The headphone may also include one or more integrated circuits and a jack to connect the headphone to the electronic device 100 (not shown) using digital signals, which may be sampled and quantized.

In another embodiment, the earcups $\mathbf{10}_1$, $\mathbf{10}_2$ are wireless and may also include a battery device, a processor, and a communication interface (not shown). In this embodiment, the processor may be a digital signal processing chip that processes the acoustic signal from at least three of the microphones $\mathbf{11}_1$-$\mathbf{11}_m$. In one embodiment, the processor may control or include at least one of: the earcup detector 131, the microphone selector (beamformer) 132, the noise suppressor 133 or the automatic gain control (AGC) 134 in FIG. 7. While not illustrated in FIG. 7, in one embodiment, the system 700 may include an on-head detector that detects whether the headphones have been placed on the user's head. In one embodiment, the on-head detector may be based on strain gauge detection which detects whether the headphones have been stretched or pulled apart from the neutral (e.g., not-on-head state) to indicate that the headphones have been placed on the user's head. In this embodiment, the on-head detector may signal to the ear cup detector that automatic right or left ear detection is to be performed.

The communication interface may include a Bluetooth™ receiver and transmitter which may communicate speaker audio signals or microphone signals from the microphones $\mathbf{11}_1$-$\mathbf{11}_m$ wirelessly in both directions (uplink and downlink) with the electronic device 100. In some embodiments, the communication interface communicates encoded signal from a speech codec (not shown) to the electronic device 100.

In the embodiments described herein, since the headphones that include two identical earcups $\mathbf{10}_1$, $\mathbf{10}_2$ that may be worn in two alternative placements (FIGS. 2 and 3), the system needs to know which earcup $\mathbf{10}_1$, $\mathbf{10}_2$ is currently worn on the right ear in order to allow for audio beamforming of the optimal microphones towards the direction of the user's mouth (FIG. 4), to allow for playing audio on the correct right and left ear correspondingly to the right and left stereo channels, and to provide an accurate voice activity detection (VAD) signal that can be used to estimate the ambient noise for noise suppression or to drive an automatic gain controller (AGC) as well as being used in other modules of the audio voice processing uplink chain.

Figure 7:
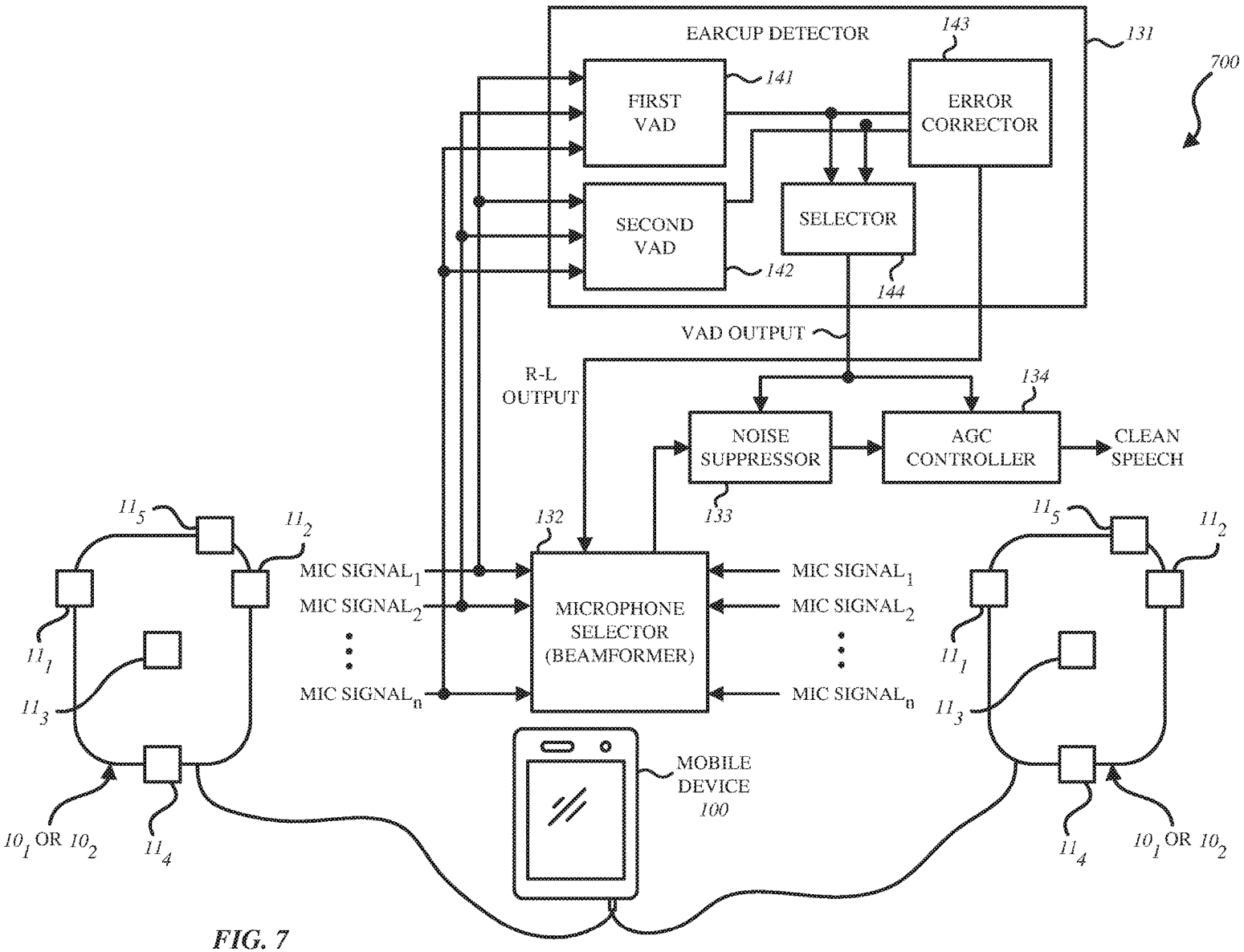
FIG. 7 illustrates a block diagram of a system for right-left ear detection for a headphone in accordance with one embodiment of the invention.

FIG. 7 illustrates a block diagram of a system 700 for right-left ear detection for a headphone in accordance with one embodiment of the invention. The system 700 in FIG. 7 includes the headphone having the pair of earcups $\mathbf{10}_1$, $\mathbf{10}_2$ and an electronic device 100. While FIG. 7 illustrates the earcups $\mathbf{10}_1$, $\mathbf{10}_2$ being coupled to the electronic device 100 via a headphone wire, it is understood that the earcups $\mathbf{10}_1$, $\mathbf{10}_2$ may also be wirelessly connected to the electronic device 100.

The system 700 also includes an earcup detector 131 that includes a first voice activity detector (VAD) 141, a second VAD 142, a selector 144 which may act as a VAD signal combiner or as an OR function, and an error corrector 143. The system 700 may also include a microphone selector (beamformer) 132, a noise suppressor 133, and an AGC controller 134. While not shown, in some embodiments, the system 700 may also include a speech codec wherein the earcups $\mathbf{10}_1$, $\mathbf{10}_2$ are coupled to the electronic device 100 wirelessly and communicates the output of the speech codec 160 to the electronic device 100. In this embodiment, the earcups $\mathbf{10}_1$, $\mathbf{10}_2$ include the microphone selector (beamformer) 132, noise suppressor 133, AGC controller 134, and speech codec. In other embodiments, the earcups $\mathbf{10}_1$, $\mathbf{10}_2$ are coupled to the electronic device 100 via the headphone wire or wirelessly and the electronic device 100 include the microphone selector (beamformer) 132, noise suppressor 133, AGC controller 134, and speech codec.

The earcup detector 131 may be used during a calibration of the headphone. For example, the user may say a short word or phrase after placing the headphones on her ears. Referring to FIG. 7, the microphones $\mathbf{11}_1$-$\mathbf{11}_m$ included in each earcup $\mathbf{10}_1$, $\mathbf{10}_2$ capture acoustic signals and generate microphone signals. The earcup detector 131 receives at least three of the microphone signals from one of the earcups $\mathbf{10}_1$ or $\mathbf{10}_2$ and determines whether the first earcup $\mathbf{10}_1$ or the second earcup $\mathbf{10}_2$ is worn on the user's right ear. In other words, the earcup detector 131 determines which one of the first earcup or the second earcup is being worn on which one of the user's right or left ears. Accordingly, in one scenario, the earcup detector 131 may detect that the first earcup is being worn on the right ear such that the second earcup is being worn on the left ear. In another scenario, the earcup detector 131 may detect that the first earcup is being worn on the left ear such that the second earcup is being worn on the right ear. The earcup detector 131 performs the right-left detection to determine the current headphone orientation that the user has chosen. As shown in FIG. 7, earcup detector 131 may only use the microphone signals from one earcup to perform the detection. The earcup detector 131 further includes a first VAD 141, a second VAD 142, a selector 144, and an error corrector 143. The error corrector filters out the short spurious VAD triggers due to ambient noises or wind. Both the first VAD 141 and the second VAD 142 receives from one of the earcups $\mathbf{10}_1$ or $\mathbf{10}_2$ at least three microphone signals $\mathbf{11}_1$-$\mathbf{11}_m$.

The first VAD 141 performs comparisons of strengths of the microphone signals or performs comparisons of the ratio of the strengths of the microphone signals to a first plurality of thresholds to generate a first output. The first output indicates which one of the first earcup $\mathbf{10}_1$ is worn on the user's right ear. In one embodiment, the earcup detector 131 receives at least three microphone signals from the first earcup $\mathbf{10}_1$. In one embodiment, the at least three microphone signals include the microphone signals from the first microphone $\mathbf{11}_1$, the second microphone $\mathbf{11}_2$ and the third microphone $\mathbf{11}_3$ (FIG. 4) of first earcup $\mathbf{10}_1$. In this embodiment, the first VAD 141 generates the first output indicating that the first earcup is worn on the user's right ear when (i) a strength of the third microphone signal ($\mathbf{11}_3$) is greater than a first predetermined threshold, (ii) a ratio of the strength of the third microphone signal ($\mathbf{11}_3$) and the strength of the second microphone signal ($\mathbf{11}_2$) is greater than a second predetermined threshold, (iii) the ratio of the strength of the third microphone signal ($\mathbf{11}_3$) and the strength of the second microphone signal ($\mathbf{11}_2$) is less than a third predetermined threshold, and (iv) a ratio of the strength of the second microphone signal ($\mathbf{11}_2$) and the strength of the first microphone signal ($\mathbf{11}_1$) is greater than a fourth predetermined threshold.

In another embodiment, the at least three microphone signals include the microphone signals from the first microphone $\mathbf{11}_1$, the second microphone $\mathbf{11}_2$, the third microphone $\mathbf{11}_3$ and the fourth microphone $\mathbf{11}_4$ (FIG. 4) of first earcup $10_1$. In this embodiment, the first VAD 141 generates the first output indicating that the first earcup is worn on the user's right ear when (i) a strength of the third microphone signal ($11_3$) is greater than a first predetermined threshold, (ii) a ratio of the strength of the third microphone signal ($11_3$) and the strength of the second microphone signal ($11_2$) is greater than a second predetermined threshold, (iii) the ratio of the strength of the third microphone signal ($11_3$) and the strength of the second microphone signal ($11_2$) is less than a third predetermined threshold, (iv) a ratio of the strength of the second microphone signal ($11_2$) and the strength of the first microphone signal ($11_1$) is greater than a fourth predetermined threshold, and (v) a ratio of the strength of the fourth microphone signal ($11_4$) and the strength of the second microphone signal ($11_2$) is greater than a fifth predetermined threshold.

Similarly, the second VAD 142 in FIG. 7 also performs comparisons of strengths of the microphone signals or performs comparisons of the ratio of the strengths of the microphone signals to a second plurality of thresholds to generate a second output. The second output indicates whether the second earcup $10_2$ is worn on the user's right ear.

In one embodiment, the earcup detector 131 receives at least three microphone signals from the first earcup $10_1$. In one embodiment, the at least three microphone signals include the microphone signals from the first microphone $11_1$, the second microphone $11_2$ and the third microphone $11_3$ (FIG. 4) of first earcup $10_1$. In this embodiment, the second VAD 142 generates the second output that indicates that the second earcup $10_2$ is worn on the user's right ear when: (i) a strength of the third microphone signal ($11_3$) is greater than the first predetermined threshold, (ii) a ratio of the strength of the third microphone signal ($11_3$) and the strength of the first microphone signal ($11_1$) is greater than the second predetermined threshold, (iii) the ratio of the strength of the third microphone signal ($11_3$) and the strength of the first microphone signal ($11_1$) is less than a third predetermined threshold, and (iv) a ratio of the strength of the first microphone signal ($11_1$) and the strength of the second microphone signal ($11_2$) is greater than a fourth predetermined threshold.

In another embodiment, the at least three microphone signals include the microphone signals from the first microphone $11_1$, the second microphone $11_2$, the third microphone $11_3$ and the fourth microphone $11_4$ (FIG. 4) of first earcup $10_1$. In this embodiment, the second VAD 142 generates the second output that indicates that the second earcup $10_2$ is worn on the user's right ear when (i) a strength of the third microphone signal ($11_3$) is greater than the first predetermined threshold, (ii) a ratio of the strength of the third microphone signal ($11_3$) and the strength of the first microphone ($11_1$) signal is greater than the second predetermined threshold, (iii) the ratio of the strength of the third microphone signal ($11_3$) and the strength of the first microphone signal ($11_1$) is less than a third predetermined threshold, (iv) a ratio of the strength of the first microphone signal ($11_1$) and the strength of the second microphone signal ($11_2$) is greater than a fourth predetermined threshold, and (v) a ratio of the strength of the fourth microphone signal ($11_4$) and the strength of the first microphone signal ($11_1$) is greater than a fifth predetermined threshold.

In one embodiment, prior to being processed by the first and the second VAD 141, 142, the microphone signals may be transformed from a time domain to a frequency domain and bandpass filtered in a predetermined frequency band. In this embodiment, the strength of the microphone signals is computed within the predetermined frequency band. In this embodiment, the strength of the microphone signals is determined from the predetermined frequency band. In one embodiment, the strength of the microphone signals is the sum of spectral magnitudes of each of the microphones between 200 Hz and 400 Hz.

In another embodiment, prior to being processed by the first and the second VAD 141, 142, the microphone signals may also be bandpass filtered in the time domain to a predetermined frequency band and the strength of the microphone signals is thus the output of the bandpass filters within the predetermined frequency band.

Referring back to FIG. 7, the output from the first VAD 141 and the output from the second VAD 142 are received by the error corrector 143 which performs an error check based on the outputs from the first and second VADs 141, 142 and eliminates the short spurious VAD triggers due to ambient noise or wind. The error corrector 143 thus generates a signal indicating which one the first earcup $10_1$ or the second earcup $10_2$ is being worn on the user's right ear. In one embodiment, the error corrector 143 eliminates single frame VADs from creating an error to the detector output (e.g., R-L output). In one embodiment, the error corrector 143 outputs a detection output equal to 1 which indicates that the first earcup is being worn on the right ear and equal to 0 which indicates that the second earcup is being worn on the right ear.

In some embodiments, the selector 144 generates a binary output as a voice activity detector (VAD), regardless if first earcup or second earcup is worn on the right ear. This binary output is generated as an OR function from the first VAD 141 and second VAD 142.

As shown in FIG. 7, the microphone selector (beamformer) 132 receives the detector output from the error corrector 143 and receives a plurality of microphone signals from the first earcup $10_1$ and the second earcup $10_2$. The microphone selector (beamformer) 132 selects the microphones $11_2$ and $11_5$ used for speech transmission from either first cup $10_1$ or second cup $10_2$ depending on which earcup is on the right ear. These microphones can be used for beamforming or just the selection of the second microphone $11_2$ to be transmitted to the noise suppressor 133. In one embodiment, when the first earcup $10_1$ is identified as being worn on the right ear, the microphone selector (beamformer) 132 receives the microphone signals from the second microphone $11_2$ and the fifth microphone $11_5$ from the first earcup $10_1$ to generate a voice beam towards the user's mouth. As shown in FIG. 4, when the first earcup $10_1$ is identified as being worn on the right ear, the second microphone $11_2$ is closer to the user's mouth than the first microphone $11_1$. In one embodiment, the microphone selector (beamformer) 132 may generate the noise beam signal pointing a null towards user's mouth using the second microphone $11_2$ and the fifth microphone $11_5$ in the first earcup $10_1$ when the first earcup $10_1$ is worn on the right ear.

In another embodiment, each earcup $10_1$, $10_2$ also includes a sixth microphone $11_6$ (not shown) located adjacent to the first microphone $11_1$ and between the first microphone $11_1$ and the fifth microphone $11_5$. The sixth microphone $11_6$ and the first microphone $11_1$ of the first earcup $10_1$ are located on the half of the earphone that is farther from the user's mouth when the first earcup $10_1$ is worn on the right ear. In this embodiment, when the first earcup $10_1$ is worn on the right ear, the microphone selector (beamformer) 132 may also select first microphone $11_1$ and sixth microphone $11_6$ to form a voice beam and a noise beam using the microphone signals from the second earcup $10_2$ which is worn on the left ear.

In FIG. 7, the beamformer signal that is generated with microphones selected by the microphone selector 132 is received by the noise suppressor 133. In another embodiment, the beamformer 132 may generate a noise signal and a voice signal and the noise suppressor receives both the signals.

The noise suppressor 133 may suppress noise in the voice beam signal based on the VAD output received from the earcup detector 131 or based on the spectral separation between the voice beam and the noise beam. The noise suppressed voice beam signal is then outputted to the AGC controller 134. The AGC controller 134 performs AGC on the noise suppressed signal based on the VAD output received from the earcup detector 131.

The following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 5:
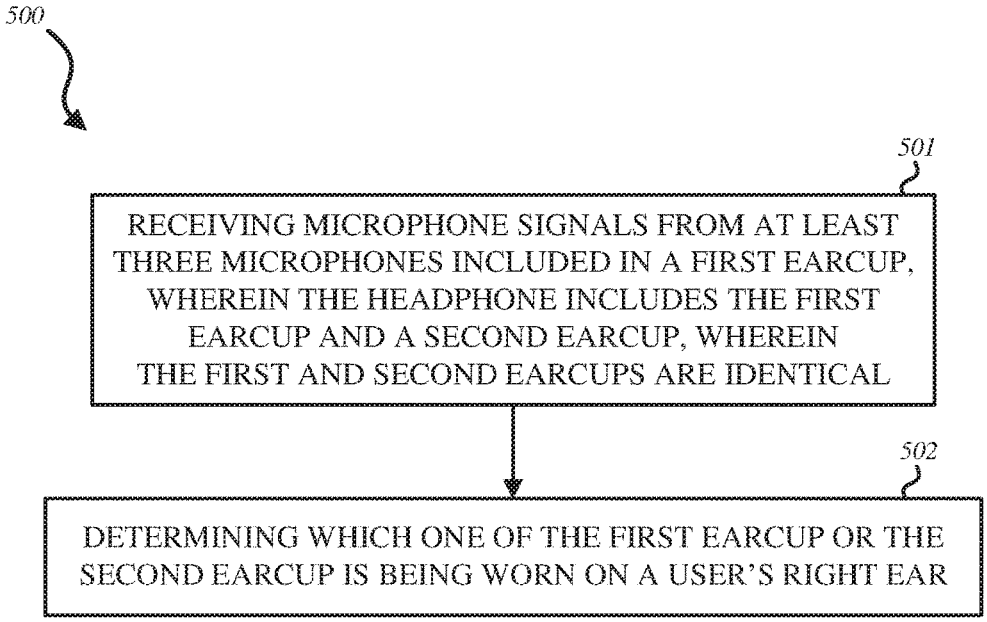
FIG. 5 illustrates a flow diagram of an example method for right-left ear detection for a headphone in accordance with one embodiment of the invention.

FIG. 5 illustrates a flow diagram of an example method 500 for right-left ear detection for a headphone in accordance with one embodiment of the invention. The method 500 starts at Block 501 with an earcup detector receiving microphone signals from at least three microphones included in a first earcup $10_1$. The headphone includes the first earcup and a second earcup which are identical earcups. At Block 502, the earcup detector determines which one of the first earcup or the second earcup is being worn on a user's right ear.

Figure 6:
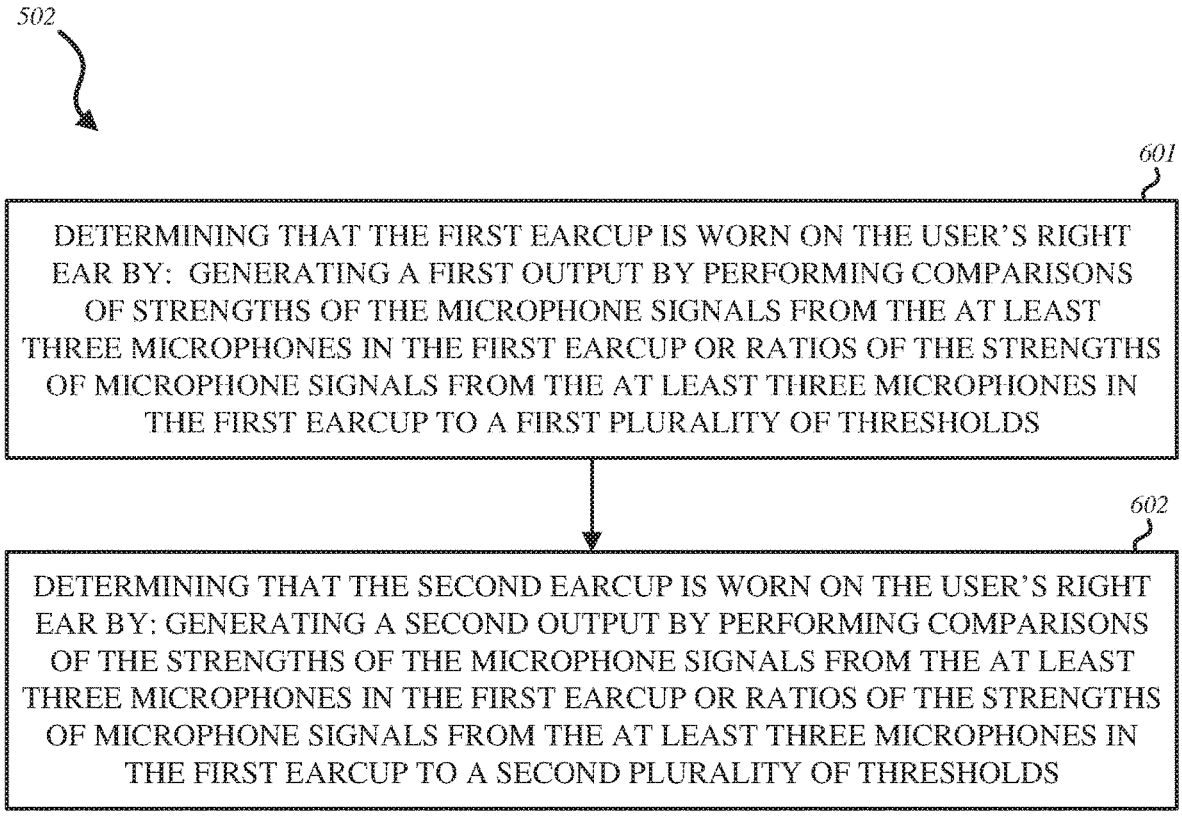
FIG. 6 illustrates a flow diagram of an example method of determining which one of the first earcup or the second earcup is being worn on a user's right ear from FIG. 5 in accordance with one embodiment of the invention.

FIG. 6 illustrates a flow diagram of an example method of determining which one of the first earcup or the second earcup is being worn on a user's right ear in Block 502 from FIG. 5 in accordance with one embodiment of the invention. In Block 601, the earcup detector determines that the first earcup is worn on the user's right ear by generating a first output by performing comparisons of strengths of the microphone signals from the at least three microphones in the first earcup or ratios of the strengths of microphone signals from the at least three microphones in the first earcup to a first plurality of thresholds.

In Block 602, the earcup detector determines that the second earcup is worn on the user's right ear by generating a second output by performing comparisons of the strengths of the microphone signals from the at least three microphones in the first earcup or ratios of the strengths of microphone signals from the at least three microphones in the first earcup to a second plurality of thresholds.

Figure 8:
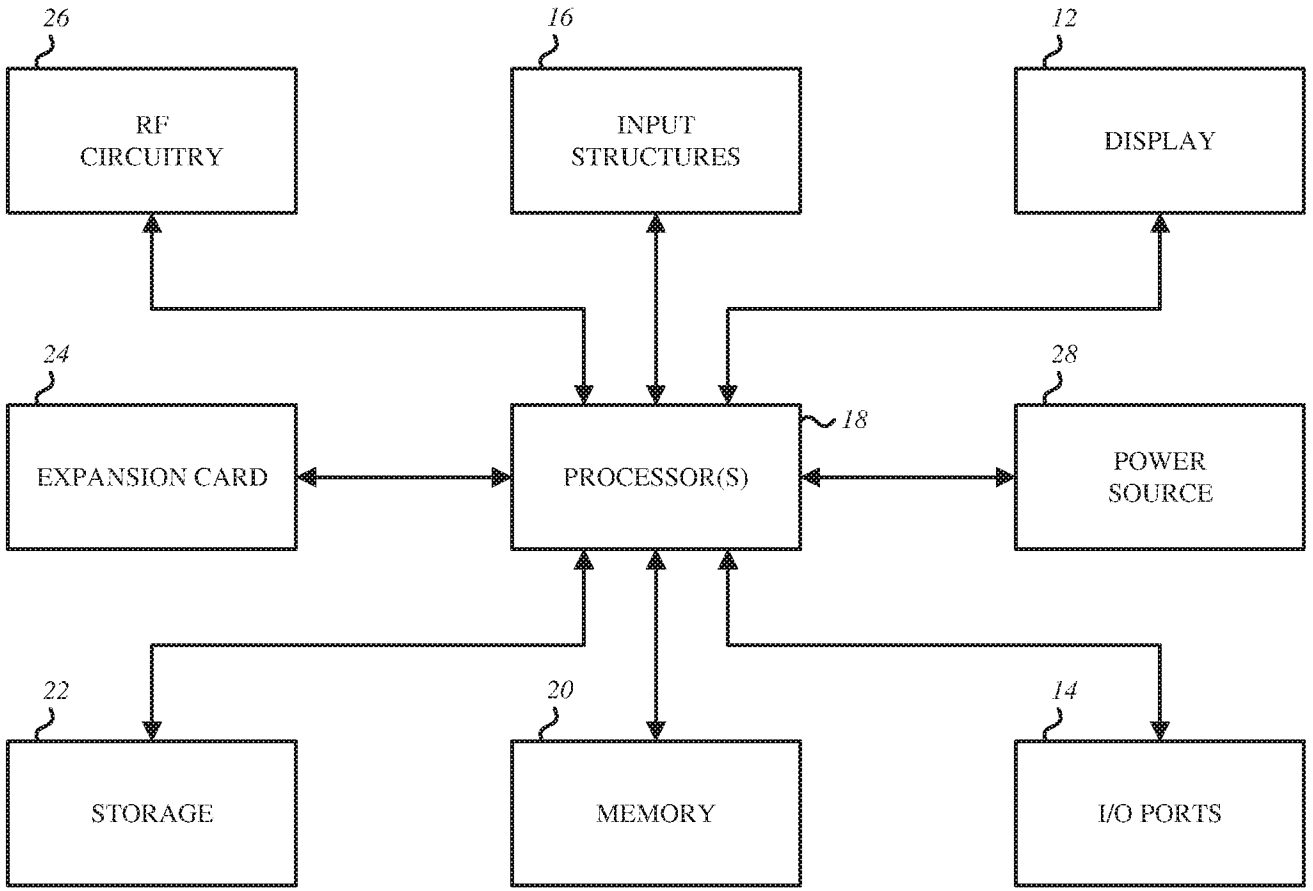
FIG. 8 is a block diagram of exemplary components of a mobile device included in the system in FIG. 7 for right-left ear detection for a headphone in accordance with aspects of the present disclosure.

FIG. 8 is a block diagram of exemplary components of an electronic device 100 included in the system in FIG. 7 in accordance with aspects of the present disclosure. Specifically, FIG. 8 is a block diagram depicting various components that may be present in electronic devices suitable for use with the present techniques. The electronic device 100 may be in the form of a computer, a handheld portable electronic device such as a cellular phone, a mobile device, a personal data organizer, a computing device having a tablet-style form factor, etc. These types of electronic devices, as well as other electronic devices providing comparable voice communications capabilities (e.g., VoIP, telephone communications, etc.), may be used in conjunction with the present techniques.

Keeping the above points in mind, FIG. 8 is a block diagram illustrating components that may be present in one such electronic device 100, and which may allow the device 100 to function in accordance with the techniques discussed herein. The various functional blocks shown in FIG. 8 may include hardware elements (including circuitry), software elements (including computer code stored on a computer-readable medium, such as a hard drive or system memory), or a combination of both hardware and software elements. It should be noted that FIG. 8 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

The invention claimed is:

1. A method for right-left ear detection for a headphone comprising:

receiving microphone signals from at least three microphones included in a first earcup, wherein the headphone includes the first earcup and a second earcup, wherein the first and second earcups are interchangeable;

determining which one of the first earcup or the second earcup is being worn on which one of the user's right or left ears, wherein determining includes:

generating a first output by performing comparisons of i) strengths of the microphone signals from the at least three microphones in the first earcup or ratios of the strengths of microphone signals from the at least three microphones in the first earcup to ii) a first plurality of thresholds, and generating a second output by performing comparisons of i) the strengths of the microphone signals from the at least three microphones in the first earcup or ratios of the strengths of microphone signals from the at least three microphones in the first earcup to ii) a second plurality of thresholds.

2. The method of claim 1, wherein the at least three microphones in each of the first earcup and second earcup include a first microphone generating a first microphone signal, a second microphone generating a second microphone signal and a third microphone generating a third microphone signal.

3. The method of claim 2, wherein the first plurality of thresholds comprises first, second, third, and fourth predetermined thresholds, and wherein the first output indicates that the first earcup is being worn on a particular ear of the user when (i) a strength of the third microphone signal is greater than the first predetermined threshold, (ii) a ratio of the strength of the third microphone signal and the strength of the second microphone signal is greater than the second predetermined threshold, (iii) the ratio of the strength of the third microphone signal and the strength of the second microphone signal is less than the third predetermined threshold, and (iv) a ratio of the strength of the second microphone signal and the strength of the first microphone signal is greater than the fourth predetermined threshold, wherein the particular ear of the user is one of the right ear or the left ear.

4. The method of claim 2, wherein the second plurality of threshold comprises first, second, third, and fourth predetermined thresholds, and wherein the second output indicates that the second earcup is being worn on a particular ear of the user when:

(i) a strength of the third microphone signal is greater than the first predetermined threshold, (ii) a ratio of the strength of the third microphone signal and the strength of the first microphone signal is greater than the second predetermined threshold, (iii) the ratio of the strength of the third microphone signal and the strength of the first microphone signal is less than the third predetermined threshold, and (iv) a ratio of the strength of the first microphone signal and the strength of the second microphone signal is greater than the fourth predetermined threshold.

5. The method of claim 2, wherein the first plurality of thresholds comprises first, second, third, fourth, and fifth predetermined thresholds, and wherein the at least three microphones in the first earcup further include a fourth microphone generating a fourth microphone signal, wherein the first output indicates that the first earcup is being worn on a particular ear of the user when (i) a strength of the third microphone signal is greater than the first predetermined threshold, (ii) a ratio of the strength of the third microphone signal and the strength of the second microphone signal is greater than the second predetermined threshold, (iii) the ratio of the strength of the third microphone signal and the strength of the second microphone signal is less than the third predetermined threshold, (iv) a ratio of the strength of the second microphone signal and the strength of the first microphone signal is greater than the fourth predetermined threshold, and (v) a ratio of the strength of the fourth microphone signal and the strength of the second microphone signal is greater than the fifth predetermined threshold.

6. The method of claim 2, wherein the first plurality of thresholds comprises first, second, third, fourth, and fifth predetermined thresholds, and wherein the at least three microphones in the second earcup further include a fourth microphone generating a fourth microphone signal, wherein the second output indicates that the second earcup is worn on a particular ear of the user when:

(i) a strength of the third microphone signal is greater than the first predetermined threshold, (ii) a ratio of the strength of the third microphone signal and the strength of the first microphone signal is greater than the second predetermined threshold, (iii) the ratio of the strength of the third microphone signal and the strength of the first microphone signal is less than the third predetermined threshold, (iv) a ratio of the strength of the first microphone signal and the strength of the second microphone signal is greater than the fourth predetermined threshold, and (v) a ratio of the strength of the fourth microphone signal and the strength of the first microphone signal is greater than the fifth predetermined threshold.

7. The method of claim 1, wherein determining which one of the first earcup or the second earcup is being worn on which one of the user's right or left ears further includes:

generating a signal indicating which one of the first earcup or the second earcup is being worn on a particular ear of the user by performing an error correction using the first output and the second output to eliminate spurious single frames.

8. The method of claim 7, further comprising:

generating a voice beam signal and a noise beam signal based on at least two microphone signals received from the earcup identified by the signal as being worn on the particular ear of the user.

9. The method of claim 1, further comprising:

transforming the microphone signals from the at least three microphones in time domain by bandpass filtering the microphone signals in a predetermined frequency band, wherein the strength of the bandpass filtered microphone signals from the at least three microphones is determined from the predetermined frequency band.

10. The method of claim 1, further comprising:

transforming the microphone signals from the at least three microphones from a time domain to a frequency domain; and filtering the microphone signals in the frequency domain in a plurality of frequency bins, wherein the strength of the microphone signals from the at least three microphones is determined by summing one of the plurality of frequency bins or all of the plurality of frequency bins.

11. The method of claim 1 wherein the first earcup and second earcup have identical microphone configurations.

12. An article of manufacture comprising:

a non-transitory computer-readable medium having stored thereon instructions that when executed by a processor causes the processor to receive microphone signals from at least three microphones included in a first earcup of a headphone, wherein the at least three microphones in the first earcup include a first microphone to generate a first microphone signal, a second microphone to generate a second microphone signal, and a third microphone to generate a third microphone signal, and the headphone includes the first earcup and a second earcup, wherein the first and second earcups are interchangeable, determine which one of the first earcup or the second earcup is being worn on which one of the user's right or left ears, by generating a first output by performing comparisons of i) strengths of the microphone signals from the at least three microphones in the first earcup or ratios of the strengths of microphone signals from the at least three microphones in the first earcup to ii) a first plurality of threshold, and generating a second output by performing comparisons of i) the strengths of the microphone signals from the at least three microphones in the first earcup or ratios of the strengths of the microphone signals from the at least three microphones in the first earcup to ii) a second plurality of thresholds.

13. The article of manufacture of claim 12 wherein the first plurality of thresholds and the second plurality of thresholds comprises first, second, third, and fourth predetermined thresholds, and wherein the first output indicates that the first earcup is being worn on a particular ear of the user when (i) a strength of the third microphone signal is greater than the first predetermined threshold, (ii) a ratio of the strength of the third microphone signal and the strength of the second microphone signal is greater than the second predetermined threshold, (iii) the ratio of the strength of the third microphone signal and the strength of the second microphone signal is less than the third predetermined threshold, and (iv) a ratio of the strength of the second microphone signal and the strength of the first microphone signal is greater than the fourth predetermined threshold, and wherein the second output indicates that the second earcup is being worn on the particular ear of the user when (i) a strength of the third microphone signal is greater than the first predetermined threshold, (ii) a ratio of the strength of the third microphone signal and the strength of the first microphone signal is greater than the second predetermined threshold, (iii) the ratio of the strength of the third microphone signal and the strength of the first microphone signal is less than the third predetermined threshold, and (iv) a ratio of the strength of the first microphone signal and the strength of the second microphone signal is greater than the fourth predetermined threshold.

14. The non-transitory computer-readable medium of claim 12, wherein the first plurality of thresholds and the second plurality of thresholds comprises first, second, third, fourth, and fifth predetermined thresholds, and wherein the at least three microphones in the first earcup further include a fourth microphone generating a fourth microphone signal, wherein the first output indicates that the first earcup is being worn on a particular ear of the user when (i) a strength of the third microphone signal is greater than the first predetermined threshold, (ii) a ratio of the strength of the third microphone signal and the strength of the second microphone signal is greater than the second predetermined threshold, (iii) the ratio of the strength of the third microphone signal and the strength of the second microphone signal is less than the third predetermined threshold, (iv) a ratio of the strength of the second microphone signal and the strength of the first microphone signal is greater than the fourth predetermined threshold, and (v) a ratio of the strength of the fourth microphone signal and the strength of the second microphone signal is greater than the fifth predetermined threshold.

15. The non-transitory computer-readable medium of claim 12, wherein the at least three microphones in the first earcup further include a fourth microphone generating a fourth microphone signal, wherein the second output indicates that the second earcup is being worn on a particular ear of the user when:

(i) a strength of the third microphone signal is greater than the first predetermined threshold, (ii) a ratio of the strength of the third microphone signal and the strength of the first microphone signal is greater than the second predetermined threshold, (iii) the ratio of the strength of the third microphone signal and the strength of the first microphone signal is less than a fifth predetermined threshold, (iv) a ratio of the strength of the first microphone signal and the strength of the second microphone signal is greater than a fourth predetermined threshold, and (v) a ratio of the strength of the fourth microphone signal and the strength of the first microphone signal is greater than the fifth predetermined threshold.

16. The non-transitory computer-readable medium of claim 12, wherein the first earcup and second earcup have identical microphone configurations.

17. A processor for use with a headphone, the processor comprising a processor configured to:

receive microphone signals from at least three microphones included in a first earcup of the headphone; and determine which one of the first earcup or a second earcup of the headphone is being worn on which one of a user's right or left ears, by:

generating a first output by performing comparisons of i) strengths of the microphone signals from the at least three microphones in the first earcup or ratios of the strengths of microphone signals from the at least three microphones in the first earcup to ii) a first plurality of thresholds; and generating a second output by performing comparisons of i) the strengths of the microphone signals from the at least three microphones in the first earcup or ratios of the strengths of microphone signals from the at least three microphones in the first earcup to ii) a second plurality of thresholds.

18. The processor of claim 17, wherein the at least three microphones in each of the first earcup and second earcup include a first microphone generating a first microphone signal, a second microphone generating a second microphone signal and a third microphone generating a third microphone signal.

19. The processor of claim 18, wherein the first plurality of thresholds comprises first, second, third, and fourth predetermined thresholds, and wherein the first output indicates that the first earcup is being worn on a particular ear of the user when (i) a strength of the third microphone signal is greater than the first predetermined threshold, (ii) a ratio of the strength of the third microphone signal and the strength of the second microphone signal is greater than the second predetermined threshold, (iii) the ratio of the strength of the third microphone signal and the strength of the second microphone signal is less than the third predetermined threshold, and (iv) a ratio of the strength of the second microphone signal and the strength of the first microphone signal is greater than the fourth predetermined threshold, wherein the particular ear of the user is one of the right or the left ear.

20. The processor of claim 18, wherein the second plurality of threshold comprises first, second, third, and fourth predetermined thresholds, and wherein the second output indicates that the second earcup is being worn on a particular ear of the user when:

(i) a strength of the third microphone signal is greater than the first predetermined threshold, (ii) a ratio of the strength of the third microphone signal and the strength of the first microphone signal is greater than the second predetermined threshold, (iii) the ratio of the strength of the third microphone signal and the strength of the first microphone signal is less than the third predetermined threshold, and (iv) a ratio of the strength of the first microphone signal and the strength of the second microphone signal is greater than the fourth predetermined threshold.

21. The processor of claim 18, wherein the first plurality of thresholds comprises first, second, third, fourth, and fifth predetermined thresholds, and wherein the at least three microphones in the first earcup further include a fourth microphone generating a fourth microphone signal, wherein the first output indicates that the first earcup is being worn on a particular ear of the user when (i) a strength of the third microphone signal is greater than the first predetermined threshold, (ii) a ratio of the strength of the third microphone signal and the strength of the second microphone signal is greater than the second predetermined threshold, (iii) the ratio of the strength of the third microphone signal and the strength of the second microphone signal is less than the third predetermined threshold, (iv) a ratio of the strength of the second microphone signal and the strength of the first microphone signal is greater than the fourth predetermined threshold, and (v) a ratio of the strength of the fourth microphone signal and the strength of the second microphone signal is greater than the fifth predetermined threshold.

22. The processor of claim 18, wherein the first plurality of thresholds comprises first, second, third, fourth, and fifth predetermined thresholds, and wherein the at least three microphones in the second earcup further include a fourth microphone generating a fourth microphone signal, wherein the second output indicates that the second earcup is worn on a particular ear of the user when:

(i) a strength of the third microphone signal is greater than the first predetermined threshold, (ii) a ratio of the strength of the third microphone signal and the strength of the first microphone signal is greater than the second predetermined threshold, (iii) the ratio of the strength of the third microphone signal and the strength of the first microphone signal is less than the third predetermined threshold, (iv) a ratio of the strength of the first microphone signal and the strength of the second microphone signal is greater than the fourth predetermined threshold, and (v) a ratio of the strength of the fourth microphone signal and the strength of the first microphone signal is greater than the fifth predetermined threshold.

23. The processor of claim 17, wherein determining which one of the first earcup or the second earcup is being worn on which one of the user's right or left ears further includes:

the processor generating an indicator signal indicating which one of the first earcup or the second earcup is being worn on a particular ear of the user by performing an error correction using the first output and the second output to eliminate spurious single frames.

24. The processor of claim 23, further comprising the processor configured to:

generate a voice beam signal and a noise beam signal based on at least two microphone signals received from the earcup identified by the indicator signal as being worn on the particular ear of the user.

25. The processor of claim 17, further comprising the processor configured to:

transform the microphone signals from the at least three microphones in time domain by bandpass filtering the microphone signals in a predetermined frequency band, wherein the strength of the bandpass filtered microphone signals from the at least three microphones is determined from the predetermined frequency band.

26. The processor of claim 17, further comprising the processor configured to:

transform the microphone signals from the at least three microphones from a time domain to a frequency domain; and filter the microphone signals in the frequency domain in a plurality of frequency bins, wherein the strength of the microphone signals from the at least three microphones is determined by summing one of the plurality of frequency bins or all of the plurality of frequency bins.

27. The processor of claim 17, wherein the first earcup and second earcup have identical microphone configurations.

* * * * *